United States Patent [19]

Grützmacher et al.

[11] Patent Number: 4,887,810

[45] Date of Patent: Dec. 19, 1989

[54] DEVICE FOR CONVEYING AND ALIGNING SHEETS IN SHEET-PROCESSING MACHINES

[75] Inventors: Bertold Grützmacher, Schriesheim; Theodor Blaser, Dielheim, both of Fed. Rep. of Germany

[73] Assignee: Heidelberger Druckmaschinen AG, Heidelberg, Fed. Rep. of Germany

[21] Appl. No.: 174,088

[22] Filed: Mar. 28, 1988

[30] Foreign Application Priority Data

Mar. 28, 1987 [DE] Fed. Rep. of Germany ..... 3710259
Feb. 13, 1988 [DE] Fed. Rep. of Germany ..... 3804576

[51] Int. Cl.[4] ..... B65H 9/00

[52] U.S. Cl. ..... 271/225; 271/113; 271/112; 271/264; 271/178

[58] Field of Search ..... 271/314, 178, 184, 225, 271/227, 250, 264, 265, 194, 196, 112, 113, 109, 4, 5, 10, 11, 114, 117, 126, 226, 251; 414/121, 123; 384/512, 610

[56] References Cited

U.S. PATENT DOCUMENTS 3,630,518 12/1971 Street .
3,910,402 10/1975 Dean ..... 271/227 X
3,917,258 11/1975 Miller ..... 271/225 X
4,314,644 2/1982 Stocker ..... 271/225 X
4,411,418 10/1983 Poehlein ..... 271/236
4,483,530 11/1984 Spencer et al. ..... 271/225 X
4,669,718 6/1987 Rovin ..... 271/227
4,730,824 3/1988 Huau et al. ..... 271/227

FOREIGN PATENT DOCUMENTS 830344 1/1952 Fed. Rep. of Germany ..... 271/251
2518220 11/1976 Fed. Rep. of Germany .
2604379 8/1977 Fed. Rep. of Germany .
0140450 11/1980 Japan ..... 271/184

OTHER PUBLICATIONS

Xerox Disclosure Journal, vol. 8, No. 6, Nov./Dec. 1983, "Vacuum Registration for a Recirculation Vacuum Corrugation Feeder"; pp. 481, 482.
Document Cornering Mechanism, IBM Technical Disclosure Bulletin, vol. 14, No. 7, Dec. 71, H. D. Groenwald and D. D. Towne, p. 2179.

*Primary Examiner*—Joseph J. Rolla
*Assistant Examiner*—Stephen B. Parker
*Attorney, Agent, or Firm*—Herbert L. Lerner; Laurence A. Greenberg

[57] ABSTRACT

A device for conveying and aligning a sheet in a sheet-processing machine, with at least one frictionally driven ball having a dome facing towards the sheets for engaging a broad surface of the sheet and for moving the sheet in its plane includes structure for supporting the ball so that it is rotatable in all directions about a fixed mid-point thereof, and at least two frictional-force transmission locations located at the periphery of the ball and disposed at least 90° from one another.

18 Claims, 4 Drawing Sheets

DEVICE FOR CONVEYING AND ALIGNING SHEETS IN SHEET-PROCESSING MACHINES

The invention relates to a device for conveying and aligning sheets in sheet-processing machines, particularly sheet-fed printing machines, with at least one frictionally driven ball having a dome facing towards the sheet for engaging a broad surface of the sheet and for moving the sheet in its plane.

A device of the foregoing general type is known from U.S. Pat. No. 4,411,418 wherein a cage having a ball received therein is disposed with mutual spacing above a sheet feeding table. The cage opening which is circular in cross section has a greater diameter than that of the ball. The height of the cage and the spacing of the cage from the sheet feeding table are of such dimensions that the ball projects from both sides of the cage opening. With its lower dome projecting beyond the cage edge, the ball lies on a sheet which is to be moved whereas, at the upper dome projecting beyond the cage edge, a belt drive is in frictional engagement with the ball. The ball is thus set into rotation by the belt drive and conveys the sheet into the corner region of a pair of mutually perpendicular stop rails. This means that the belt drive also runs into the corner of these two stop rails at an inclination. The ball driven by the belt thereby offers the sheet essentially only a single defined conveyance direction. The instant the sheet thrusts against one of the two conveying edges, the further conveyance direction is determined thereby. This aforedescribed conventional embodiment has as this objective to avoid any great shearing or tangential forces to be exerted on the sheet by the driven ball in the sheet-stop position, so that no damage thereto will occur. This is possible because of the very great bearing play and because of a sector of the cage which is formed of friction material. The instant the ball comes into contact with this friction sector, namely after the sheet has stopped, the ball strives to roll on the inner wall thereof in upward direction in connection with a force reduction.

It is accordingly an object of the invention to provide a device for conveying and aligning a sheet in a sheet processing machine with a construction which is relatively simple and has advantageous control engineering features so that clearly defined sheet conveyance directions can be imposed by the ball on the sheet.

With the foregoing and other objects in view, there is provided, in accordance with the invention, a device for conveying and aligning a sheet in a sheet-processing machine, with at least one frictionally driven ball having a dome facing towards the sheet for engaging a broad surface of the sheet and for moving the sheet in its plane, comprising means for supporting the ball so that it is rotatable in all directions about a fixed mid-point thereof, and at least two frictional-force transmission locations located at the periphery of the ball and disposed at least 90° from one another.

In accordance with another feature of the invention, the dome is in contact engagement with the underside of the sheet.

In accordance with an added feature of the invention, the frictional-force transmission locations are formed as friction wheel drives.

In accordance with an additional feature of the invention, a respective one of the frictional-force transmission locations is disposed in the plane of the rotary axis of the other friction wheel.

In accordance with a further feature of the invention, the sheet is conveyed in a given conveyance direction, and the frictional-force transmission locations are in a plane passing through the mid-point of the ball and extending parallel to the conveyance direction.

In accordance with yet another feature of the invention, the friction-wheel drives are speed-controllable independently of on another.

In accordance with yet an added feature of the invention, there is provided a pneumatic supply in the region of the dome for influencing the conveying of the sheet.

In accordance with yet an additional feature of the invention, a feed-table pass-through opening formed as a suction gap is connected to a vacuum source.

In accordance with yet a further feature of the invention, the surface of the ball is formed with suction holes, and the ball has an interior connected to a vacuum source.

In accordance with still another feature of the invention, the ball is formed of sintered metal.

In accordance with still an added feature of the invention, the ball, including a mounting therefor, is surrounded by a vacuum chamber.

In accordance with still an additional feature of the invention, there is provided a feed table formed with air-injection openings disposed at a distance from the ball.

In accordance with still a further feature of the invention, the ball is freely supported by more than one bearing ball in contact engagement with the surface of the ball.

In accordance with again another feature of the invention, the friction wheel drives have axes which extend perpendicularly to one another.

In accordance with again an added feature of the invention, the surface of the ball is provided with a friction coating.

In accordance with again a further feature of the invention, the friction-sheet drives are controllable in accordance with a contact-free scanning of the sheet.

In accordance with again another feature of the invention, the drives are connected via intermediate wheels with respective friction wheels for driving the friction wheels.

In accordance with a concomitant feature of the invention, there are provided bearing balls disposed opposite the frictional-force transmission locations.

Such a construction results in a device of the initially aforementioned general type which is characterized by an enhanced utility value. After the sheet has been transferred to the ball, it is exclusively the latter which brings the sheet into a position of precise alignment and a position of feed, respectively, which is important, for example, if the sheet has to make a multiple pass through a printing machine. Additional stop rails forcing an alignment of the sheet, as is necessary in the aforedescribed state of the art, can be dispensed with. This exact alignment position of the sheet can furthermore be necessary for cutting off an edge and severing a sheet, respectively. By means of the dome projecting above the table, the ball mounted under the table so as to be rotatable in all directions about a fixed middle point thereof can be moved in its plane in any desired direction. A prerequisite therefor is the feature of the two fricitional-force transmission locations being disposed at least 90° from one another at the periphery of the ball.

To entrain the sheet, it is necessary that the friction between the dome and the sheet be greater than that between the table and the underside of the sheet. If two frictional-force transmission locations are installed, they are to be arranged perpendicularly to one another in one plane. Then, the movement of the sheet is capable of being performed in any desired direction in the sheet conveyance plane. This 90° -positioning of the frictional-force, transmission location permit the economical production of an embodiment of such a multidirectional drive. It would, however, also be possible, for example, to provide three frictional-force transmission locations at 120° angular locations with three program-controlled drive motors assigned thereto. With the introduction of two friction-force transmission locations offset 90° from one another, a simultaneous drive leads the ball into such a rotation which forces the sheet to move diagonally with respect to its in-feed direction. The angle of the diagonal movement can be varied by a mutually independent speed control which is provided. It is, therefore, in fact, possible that the side and front markers or lays of a table are reached simultaneously by the respective edges of the sheet. For example, the angle of the diagonal conveyance of the sheet for the same rotational speed of the respective drives is 45°. The alignment of the sheet can, however, by effected without lay guides or markers of the table and, in fact, by computer control of the drives as a result, for example, of optical sensing of the sheet. Because the dome of the ball engages the underside of the sheet, very great forces which can damage the sheet during its conveyance can never become effective at the sheet per se. The extent of projection of the dome beyond the sheet-supporting surface of the table can be enlisted for varying the friction between the sheet and the dome.

It is suggested, however, to construct the frictional-force transmission locations as friction-wheel drives. In order to achieve like driving conditions, both friction wheelsgears would be of the same size. Moreover, the friction-wheel drives are able to be introduced into the total structure of the device in a space-saving manner. For the purpose of avoiding relative motion between the friction surface of the friction wheel and the ball surface, the one frictional-force transmission location, respectively, is disposed in the plane of the rotational axis of the other friction wheel.

It has been found to be optimal for the frictional-force transmission locations to be in a plane passing through the mid-point of the ball and extending parallel to the conveyance direction. Slip between the ball and the friction wheels is thus largely counteracted. The corresponding movements of the frictional-force transmission locations are therefore exactly transmitted to the sheet via the ball. The friction between the dome and the underside of the sheet is increased by the suction gap defined by and between the ball and the feed-table passthrough opening and which, for its part, is connected to the vacuum source. Also in this case, a variation in the friction between the sheet and the dome is possible by suitably dimensioning the vacuum or suction. Depending upon the requirement, one or more balls can be assigned to the table, the rotational speeds of the friction-wheel drives having to be so controlled that the sheet is conveyed gently on the prescribed travel path thereof into the alignment position.

Another introducible possibility or one in combination with any of the foregoing, for varying the friction between the dome and the sheet is to form suction holes in the surface of the ball and connect the interior of the ball to the vacuum source.

The ball per se may be formed of the most varied materials, preferably of sintered metal, due to which the ball has a porous wall. It is sufficient for the dome to project beyond the table surface a distance of approximately 1.5 mm in order to ensure entrainment of the sheet. An especially desirable technical solution for connecting the annular gap and also the interior of the ball to the vacuum source is to dispose the ball including its mounting support in a vacuum chamber. A vacuum chamber or several thereof, if necessary, are then integrated into the table.

For the purpose of reducing the friction between the sheet and the table, air-blowing or injection openings are formed in the table at a spaced distance from the ball. In this way, it is possible to convey the sheet in an air-cushion manner. The injected air is suitably controlled so that the suction force in the vicinity of the dome does not lift the ball.

For a reliable positioning of the ball, a plurality of bearing balls which, together with the drive wheels if necessary or desirable, produce a three-dimensional support, are sufficient. Preferably, the arrangement of the bearing balls is such that the ball is seated on the lower bearing ball wheras other bearing balls engage the upper half of the ball and thus effect a play-free support on all sides thereof.

Conveyance of the sheet can be optimized by providing the surface of the ball with a suitable friction covering, possibly depending upon the material of the sheet. Optimum gentleness is applied to the sheet especially when the alignment is free of impacts or stops. The alignment movement of the sheet and introduction of the friction-wheel drives, respectively, can occur, for example, only when the leading edge of the sheet passes a sensing device. In spite of the 90° arrangement of the friction-force transmission locations, it is possible to arrange the drive motors of both friction-wheel drives coaxially to one another. This is permitted through the drive of the one friction-wheel via an intermediate wheel. This feature is recommended also when only limited construction space is available. To secure the positioning of the balls, the frictional-force transmission locations can, furthermore, also be applied therewith so that, possibly, one bearing ball can be dispensed with in its region. At least three bearing balls should always be provided, however, in order to achieve a defined positioning of the ball.

Other features which are considered as characteristic for the invention are set forth in the appended claims.

Although the invention is illustrated and described herein as embodied in a device for conveying and aligning sheets in sheet-processing machines, particularly sheet-fed printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
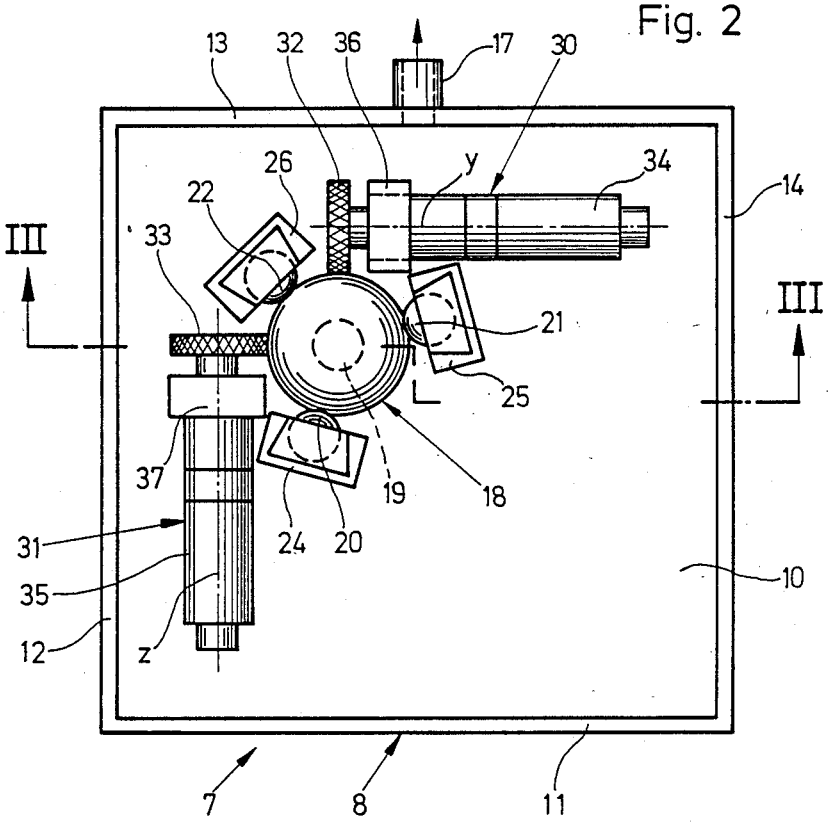
FIG. 2 is a top plan view of a vacuum chamber of the device of FIG. 1 with the cover thereof removed and which would otherwise be integrated with the table.
Figure 4:
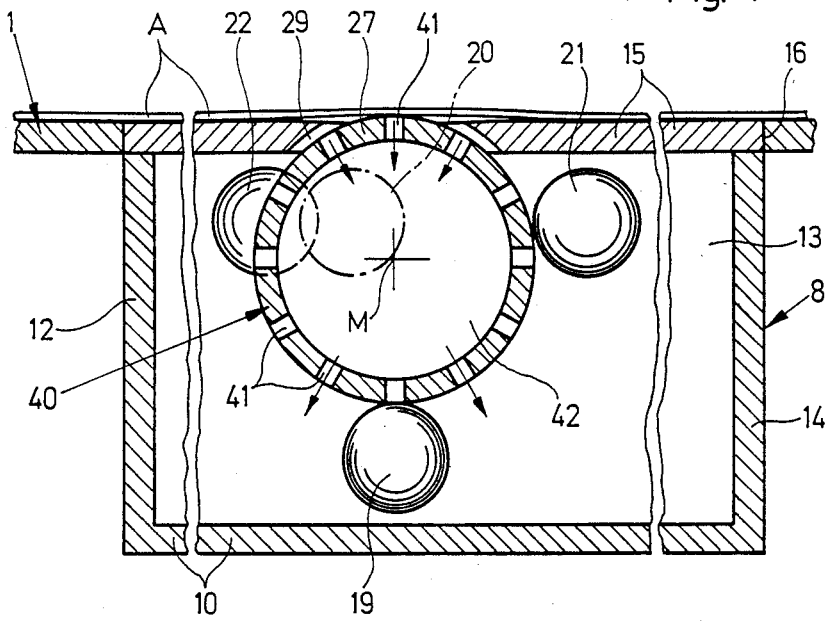
Figure 5:
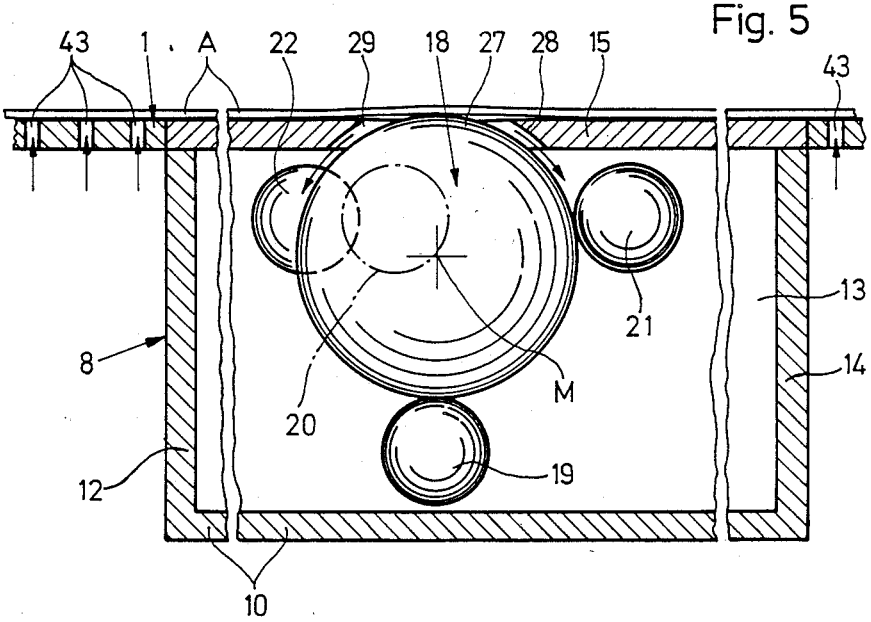
Figure 6:
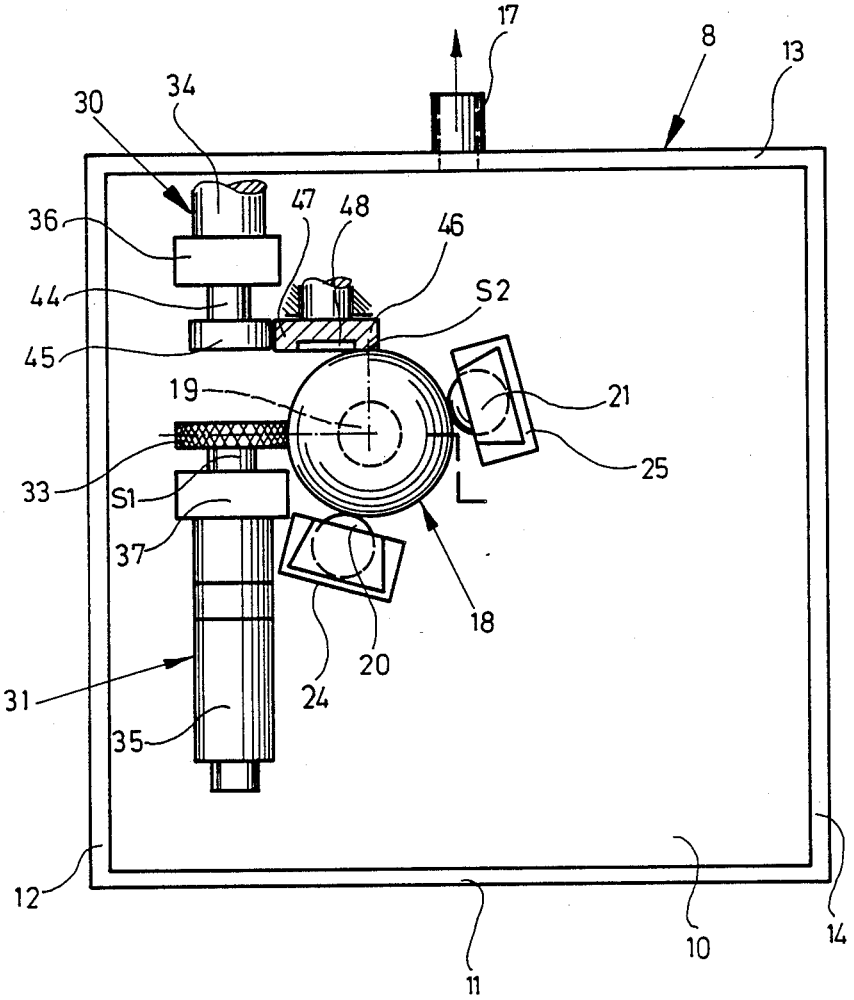

FIG. 4 is a diagrammatic vertical sectional view of another embodiment of the invention showing the vacuum chamber with a ball disposed in the latter, the surface of the ball being equipped with suction holes; and FIG. 5 is a diagrammatic vertical sectional view similar to that of FIG. 4 and showing a third embodiment of the invention in which a feed table is formed with air-injection openings disposed at a distance from the ball; and FIG. 6 is a view similar to FIG. 2 of a fourth embodiment of the invention.

Figure 1:
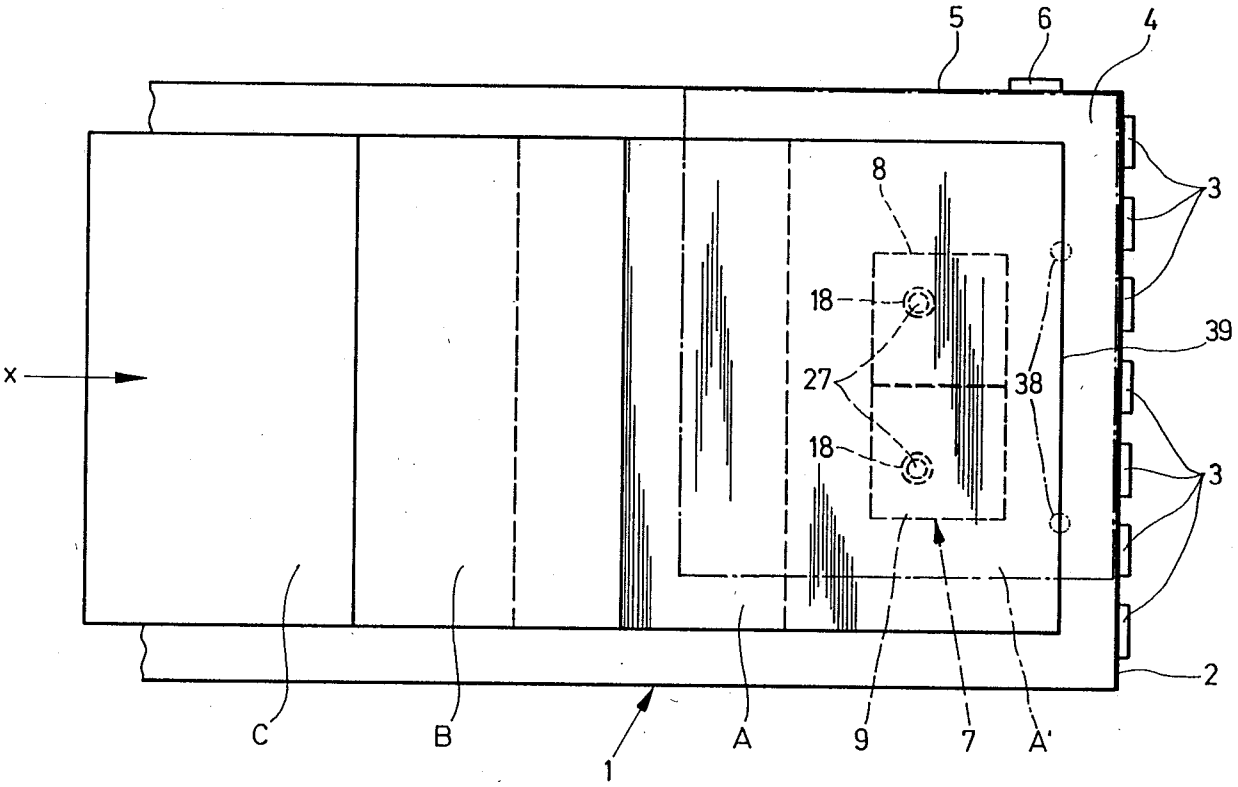
FIG. 1 is a top plan view of a table equipped with the device according to the invention, with the sheet in position on the table.

Referring now to the drawing and, first, particularly to FIG. 1 thereof, there are shown sheets which are conveyed consecutively and in a continuous stream from a non-illustrated sheet pile in the direction x onto a table 1, e.g. a feed table, of a sheet-fed printing machine, or of another sheet-processing machine. At its font narrow edge 2, the feed table 1 is provided with several front lays 3 projecting above the surface of the table. Furthermore, in its front region 4, at one of its longitudinal edges 5, the feed table has a side lay 6, which likewise projects above the surface of the feed table. The process of alignment according to the invention is not, however, dependent on the existence of such lays.

A device 7 for feeding the sheets A, B, C and so forth, is assigned to the forward region 4 of the feed table 1. As shown in FIG. 1, the device 7 has two juxtaposed, box-like vacuum chambers 8 and 9, which are mirror images of one another.

Each vacuum chamber 8, 9 is equipped with a bottom 10, side walls 11, 12, 13 and 14 aligned perpendicularly to the latter, as well as with a cover 15 placed on the side walls. The cover 15 is inserted into an accurately contoured recess 16 formed in the feed table 1 and thus constitutes a part of the latter. One side wall 13 bears a connecting piece or union 17, which can be connected to a vacuum source via a non-illustrated line.

Figure 3:
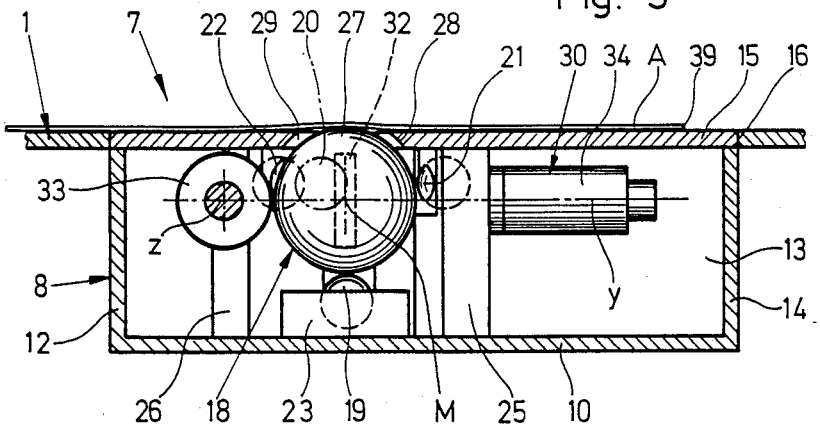
FIG. 3 is cross-sectional view of FIG. 2 taken along the line III—III in the direction of the arrows.

A ball 18, rotatable in all directions about a fixed mid-point M, is held in each vacuum chamber 8, 9 by means of four bearing balls 19, 20, 21 and 22, which contact the surface of the ball 18. The bearing balls 19, 20, 21 and 22 are seated in small bearing blocks 23, 24, 25 and 26 attached to the bottom 10. Rotatable in he small bearing block 23, the bearing ball 19 extends vertically below the mid-point M of the ball 18. The other three bearing balls 20, 21, 22 are disposed in a uniform circumferential distribution with respect to the ball, lie on a common horizontal plane and contact the surface of the upper half of the ball, thus positioning the ball 18. The small bearing blocks and the bearing balls are so disposed that the ball 18 is held with zero play. The ball 18 extends beyond the feed table 1 with a dome 27, which projects above the latter, the extent of its projection being approximately 1.5 mm. To enable the dome 27 to project above the feed table, a pass-through opening 28 is provided in the vacuum-chamber cover 15. A suction gap 29 is formed between the pass-through opening 28 and the surface of the ball located at the same height, so that the sheet A, passing over the ball 18 according to FIG. 3, is brought by this suction gap 29 into increased friction with the dome 27 of the ball 18 as a result of the vacuum.

The ball 18 is driven by two friction-wheel drives 30 and 31, which are disposed perpendicularly to one another. The drive axis y of the friction-wheel drive 30 extends parallel to the side lay 6, while the drive axis z of the other friction-wheel drive 31 is aligned parallel to the front lays 3. Furthermore, the drive axes y and z lie at the height of the mid-point M of the ball and extend parallel to the conveyance direction. Each friction-wheel drive 30, 31 has a friction wheel 32, 33 disposed at the height of the midpoint of the ball, the friction wheels 32 and 33 being set in rotation by direct-current motors 34 and 35. Therefore, frictional-force transmission locations S1 and S2 are provided between the ball 18 and the friction wheels 32 and 33 so that, respectively, the one frictionalforce transmission location lies in the plane of the rotary axis of the other friction wheel. The direct-current motors 34 and 35, in turn, are seated in small bearing blocks 36 and 37 extending from the bottom 10 of the vacuum chamber. The diameters of the friction wheels 32 and 33 are identical. Furthermore, the friction wheels 32 and 33 are provided on the circumference thereof with a friction coating in order to permit the ball 18 to be entrained in a slip-free manner.

A feed table 1 may, for example, be assigned a scanning apparatus 38, illustrated in phantom in FIG. 1. This apparatus may, for example, be in the form of a photoelectric barrier and serves to switch on the friction-wheel drives, the rotational speeds of which are conventionally controllable independently of one another by a non-illustrated computer.

The principle of operation is as follows: in the position thereof, illustrated by solid lines in FIG. 1, for example, the moving sheet A is detected at its leading edge 39 by a scanning apparatus 38. The friction-wheel drives 30 and 31 are activated directly or via computer. If, as in the embodiment shown in FIG. 2, the friction wheels 32 and 33 rotate at identical speeds, the plane of rotation of the ball 18 will lie at an angle of 45° with respect to the conveying direction x of the sheet. Accordingly, the sheet A will be moved in a diagonal direction into contact position A′ denoted in phantom. This is the way in which the sheet undergoes precise alignment. The friction-wheel drives are stopped, for example, by the computer or via a non-illustrated contact switch, so that, after being received appropriately, the next sheet B can then be advanced into its alignment position.

In accordance with the first embodiment shown in FIGS. 1 to 3, the ball 18 may be provided with a suitable friction coating in order to improve its conveying behavior, which, however, can also be varied by the amount of projection of the dome above the surface of the feed table 1. Furthermore, variation is possible by means of the size of the suction gap 29 and/or the dimensioning of the vacuum.

In a second embodiment shown in enlarged form and illustrated in FIG. 4, like components bear the same reference characters. Differing from the first embodiment described hereinbefore, the surface of the ball 40 is provided with suction holes 41, which are evenly distributed. Because of the vacuum chamber surrounding the ball 40, the interior 42 of the ball is also connected to the vacuum source. Accordingly, the suction air is able to act, initially, through the suction gap 29 on the underside of the sheet A and, then, through the suction holes 41 in the region of the dome 27.

The third embodiment shown in cross section in FIG. 5, includes a ball 18, which is unchanged from that of the first embodiment, with a suction gap 29 in the cover 15. Differing from the first embodiment, the table 1 is formed with air-injection openings 43 disposed at a distance from the ball. The thus injected air ensures a reduced friction between the underside of the sheet A and the surface of the feed table 1. Having escaped through the air-injection openings 43, however, the air is not able to eliminate the adhesion between the sheet A and the dome 27 of the ball.

The fourth embodiment of the invention shown in FIG. 6 corresponds largely to the embodiment shown in FIGS. 2 and 3. Like components are identified by the same reference characters. The d-c motor 34 arranged coaxially with the d-c motor 35 deviates from the first embodiment. The small bearing block 36 which has also been shifted serves for holding the d-c motor 34. An intermediate wheel 45 is fixed to the drive shaft 44 of the d-c motor 34 and for its part, sets into rotation a friction wheel 46 supported in the vacuum chamber 8. The friction wheel 46 is disposed tangent to the ball 18. A broad-sided annular zone 47 serves as the driving surface of the friction wheel 46 and is formed by a centric depression 48 formed in the broad side of the friction wheel 46.

The frictional-force transmission locations S1 and S2 enclose an angle of 90° also in this embodiment. Furthermore, in this embodiment, the frictional-force transmission locations S1 and S2 lie in one plane extending through the center of the ball 18 and disposed parallel to the plane of conveyance. Moreover, the embodiment of FIG. 6 distinguishes from those of the other figures in that the small block 26 with the associated bearing ball 22 is dispensed with. The remaining three bearing balls 19, 20 and 21 which are located opposite the frictional-force transmission locations S1 and S2 serve for bracing and supporting the ball 18. The friction-force transmission locations S1 and S2 cause the pressing of the ball 18 in the direction of its bracing points which are formed by the bearing balls 19, 20 and 21 while achieving a playfree mounting of the ball 18.

We claim:

1. Device for conveying and aligning a sheet in a sheet-processing machine, with at least one frictionally driven ball having a dome facing towards the sheet for engaging a broad surface of the sheet and for moving the sheet in its plane, comprising means for supporting the ball so that it is rotatable in all directions about a fixed mid-point thereof, and at least two frictional-force transmission locations located at the periphery of the ball and disposed at least 90° from one another about said periphery.

2. Device according to claim 1, wherein the dome is in contact engagement with the underside of the sheet.

3. Device according to claim 1 wherein said frictional-force transmission locations are formed as friction-wheel drives.

4. Device according to claim 3 wherein a respective one of said frictional-force transmission locations is disposed in a plane wherein the rotary axis of the other friction is disposed.

5. Device according to claim 1 wherein the sheet is conveyed in a given conveyance direction, and said frictional-force transmission locations are in a plane passing through the mid-point of the ball and extending parallel to said conveyance direction.

6. Device according to claim 3, wherein said friction-wheel drives are speed-controllable independently of one another.

7. Device according to claim 1, including means for supplying a pneumatic force to the sheet in the region of the dome for influencing the conveying of the sheet.

8. Device according to claim 2, wherein a feed-table pass-through opening located in the vicinity of said dome and formed as a suction gap is connected to a vacuum source.

9. Device according to claim 1, wherein the surface of the ball is formed with suction holes, and the ball has an interior connected to a vacuum source.

10. Device according to claim 1, wherein the ball is formed of sintered metal.

11. Device according to claim 1, wherein the ball, including a mounting therefor, is surrounded by a vacuum chamber.

12. Device according to claim 1, including a feed table formed with air-injection openings disposed at a distance from the ball.

13. Device according to claim 1, wherein the ball is freely supported by more than one bearing ball in contact engagement with the surface of the ball.

14. Device according to claim 3, wherein said friction-wheel drives have axes which extend perpendicularly to one another.

15. Device according to claim 1, wherein the surface of the ball is provided with a friction coating.

16. Device according to claim 3, wherein said friction-wheel drives are controllable in accordance with a contact-free scanning of the sheet.

17. Device according to claim 5, wherein said drives are connected via intermediate wheels with respective friction wheels for driving said friction wheels.

18. Device according to claim 1, including bearing balls disposed opposite said frictional-force transmission locations.

* * * * *